United States Patent [19]

Niskin

[11] 4,301,995

[45] Nov. 24, 1981

[54] COUNTER-BALANCED SHEAVE

[76] Inventor: Shale J. Niskin, 3415 Chase Ave., Miami Beach, Fla. 33140

[21] Appl. No.: 222,970

[22] Filed: Jan. 7, 1981

Related U.S. Application Data

[63] Continuation of Ser. No. 105,666, Dec. 20, 1979, abandoned, which is a continuation of Ser. No. 27,311, Apr. 5, 1979, abandoned.

[51] Int. Cl.[3] ..... B66D 1/36

[52] U.S. Cl. ..... 254/411; 254/415

[58] Field of Search ..... 254/415, 405, 390, 392, 254/398, 401, 402, 405, 406, 409–413, 416, 335, 336, 284, 285

[56] References Cited

U.S. PATENT DOCUMENTS

| | | | |
|---|---|---|---|
| 660,500 | 10/1900 | Frohnert | 474/182 |
| 1,348,691 | 8/1920 | Beaumont | 254/415 |
| 1,901,498 | 3/1933 | Esseltine | 254/405 |
| 2,140,086 | 12/1938 | McKissick | 254/415 |
| 3,224,381 | 12/1965 | Stewart | 474/178 X |
| 3,332,665 | 7/1967 | Bruns | 254/416 X |
| 3,337,188 | 8/1967 | Manson | 254/412 |
| 3,372,908 | 3/1968 | McCarthy | 254/405 |
| 3,934,482 | 1/1976 | Byers | 254/371 |

FOREIGN PATENT DOCUMENTS

| | | |
|---|---|---|
| 2203359 | 8/1973 | Fed. Rep. of Germany . |

*Primary Examiner*—John M. Jillions
*Attorney, Agent, or Firm*—William A. Newton

[57] ABSTRACT

A countered-balanced sheave having a bracket with an eye bolt for suspending the sheave, a pulley rotatably mounted on the bracket with weights mounted on the bracket on each side of the eye bolt, the sheave consisting of a pair of circular members secured together, each of the members having a slot at its periphery forming a cavity for receiving a ring insert.

5 Claims, 5 Drawing Figures

COUNTER-BALANCED SHEAVE

This application is a continuation, of application Ser. No. 105,666, filed 12/20/79, now abandoned, which in turn is a continuation of application Ser. No. 27,311, filed 4/15/79 now abandoned.

BACKGROUND OF THE INVENTION

1. Field of the Invention

This invention relates to sheaves and is particularly directed to a sheave that is adapted to be suspended and having counter-balancing weights mounted above the sheave for maintaining the sheave in continuous alignment with a plane passing through the cable, and thereby avoiding improper wear of the rope and inefficient operation of the sheave.

2. Description of the Prior Art

At present, for such activities for lowering wire cables to which sensors and instruments are attached, as in hydrographic work, a freely suspended sheave is employed. However, when the wire cable is not in the vertical plane because of towing angle, the present sheave is unable to correctly lie in the plane of the line, causing undue wear on the line and the sheave, and possibly causing the cable to jump off the sheave.

The present invention is able to avoid the above indicated mal-functioning of the sheave and wire cable by mounting counter-balancing weights above the suspended sheave or pulley.

Therefore a principal object of the present invention is to provide a suspended counter-balanced sheave that will lie in the plane of the lowering line extending from the sheave at all times and under varying conditions.

A further object of the present invention is to provide a suspended counter-balanced sheave that pivots readily to maintain the planes passing through the sheave and the line in superimposed alignment to prevent undue wear of the line and the pulley as the line sways from one side to the other.

A still further object of the present invention is to provide a suspended counter-balanced sheave with a pulley having a peripheral guard there-around to prevent the line from leaving the groove in the pulley and become wedged between the pulley and the mounting thereof.

With these and other objects in view, the invention will be best understood from a consideration of the following detailed description taken in connection with the accompanying drawings forming a part of this disclosure, with the understanding, however, that the invention is not confined to any strict conformity with the showing of the drawings but may be changed or modified so long as such changes or modifications mark no material departure from the salient features of the invention as expressed in the appended claims.

DESCRIPTION OF THE PREFERRED EMBODIMENT

Figure 4:
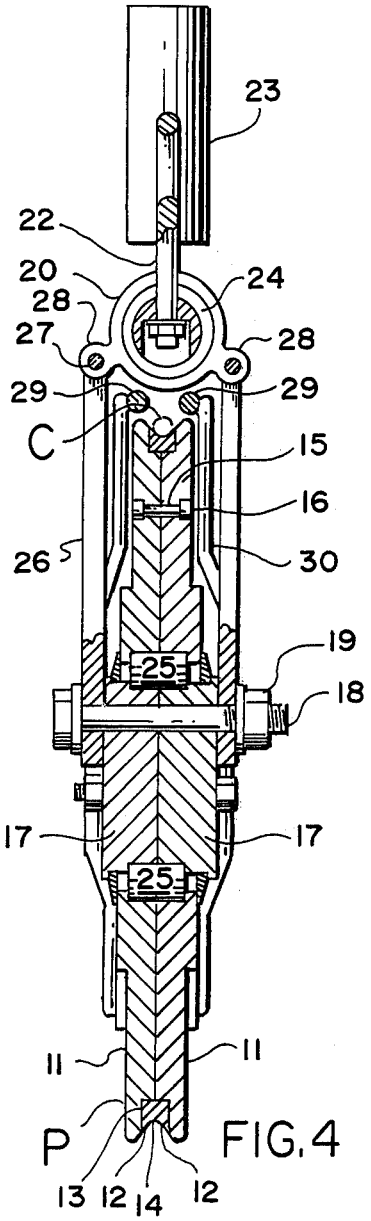
FIG. 4 is a cross sectional view taken along the line 4—4 of FIG. 2.

Referring to the drawings wherein like numerals are used to refer to similar parts throughout the various figures, the numeral 10 refers to a counter-balanced sheave constructed in accordance with my invention and consisting of a pulley -P- having a pair of identical half wheels 11 mounted face to face. Each of the half wheels 11 are provided with a peripheral slot 12 on its inner surface which form a cavity for a sheave ring insert 13. The latter is provided with an outwardly extending peripheral groove 14 whose arcuate size conforms to the size of the line, rope or cable -C- that is to be handled by the particular sheave 10. As is explained in greater detail hereinafter, the ring insert 13 is readily replaced in order to conform to the size of the cable or rope that is to pass along the sheave 10. If the cross-sectional diameter of the rope does not match the sheave rope groove, the rope will suffer distortion and become damaged. The proper size groove 14 is one that permits the rope to fit snugly therein and contact the side walls of the groove 14 at slightly less than half of circumference of the rope. The two halves 11 of the pulley -P- are held together by a plurality of bolts 15 and nuts 16 as shown by FIG. 4. The pulley -P- is rotatably mounted on a pair of fixed hubs 17 that are secured together by bolts 40 and nuts 41. Lower ends of a pair of support arms 26 extend downwardly on either side of the pulley -P- and are fastened to a bolt 18 and nut 19 to the fixed hubs 17. The upper ends of the support arms 26 are each secured to a sleeve 28 telescopically mounted over the center portion of a pin 27. Each of the pins 27 extend through further sleeves 31 by being telescopically mounted on each side of the sleeve 28 and are welded or otherwise secured to sleeves 20 that are rotatably mounted on shaft 21 on which the eye bolt 22 is itself rotatably mounted for suspending the sheave 10.

The eye bolt 22 extends through an opening 33 and terminates in counter-bored portion 34 where a nut 35 secures the eye bolt 22 against removal therefrom but permits the rotation thereof. On each side of the eye bolt 22 there is a counter-balancing weight 23 extending upwardly and attached to the sleeves 20 by means of leg members 32, the counter-balancing weights 23, sleeves 20, support arms 26 and sheave pulley -P- are rigidly secured together and mounted on the shaft 21 to pivot thereabout as a unit.

A ball bearing race 24 is positioned between the shaft 21 and the sleeves 20 to provide frictionless rotational movement thereof about the shaft 21 as the axis of rotation as the pulley -P- maintains itself in the plane of the cable -C-. Also, a ball bearing race 25 is interposed between the periphery of the hubs 17 and the sheave pulley -P- for rotational movement of the pulley -P-. Also secured to the hubs 17 is a spider -S- having arms 30 extending to a position in close proximity to the periphery of the pulley -P- where a cylindrical guide member 29 is supported. The guard members 29 prevent the cable -C- from leaving the pulley -P- to become wedged between the pulley -P- and the spider arms 30. By virtue of this particular construction of my sheave assembly 10, the cable -C- does not have to be threaded onto the pulley -P- by having to insert one end of the cable between the spider arms 30. The operator of my sheave device 10 can grasp the bite of the cable -C-, which is that portion of the cable intermediate its ends, and slide it between the sleeves 28 and 31, 31 which are separated by removing one of the pins 27 therefrom, thereby causing the upper assembly to rotate about the other pin 27.

Figure 1:
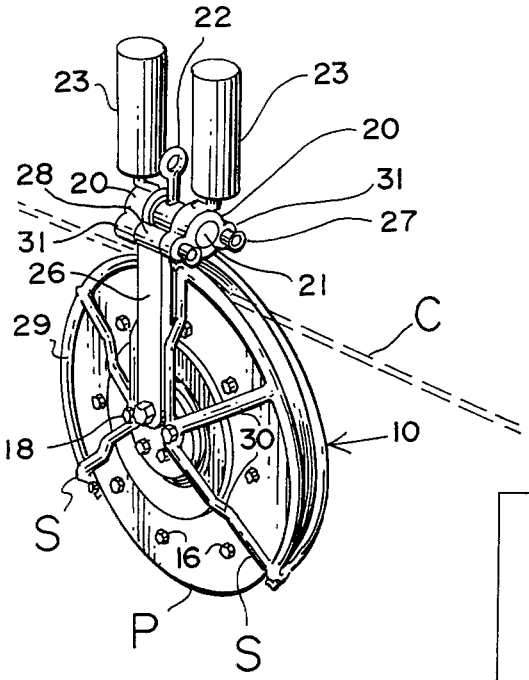
FIG. 1 is a perspective view of a counter-balanced sheave constructed in accordance with my invention.
Figure 2:
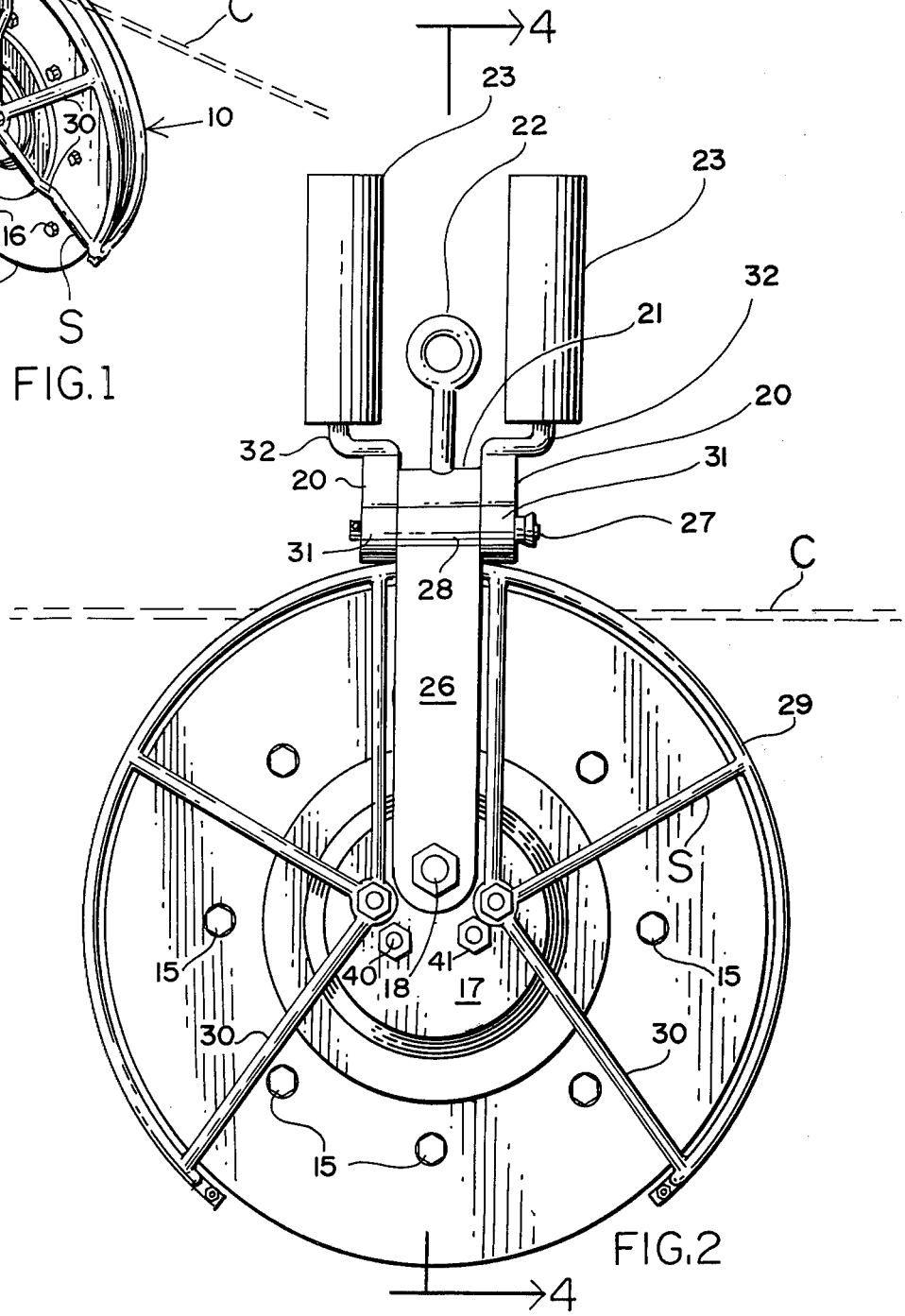
FIG. 2 is a side elevational view.
Figure 5:
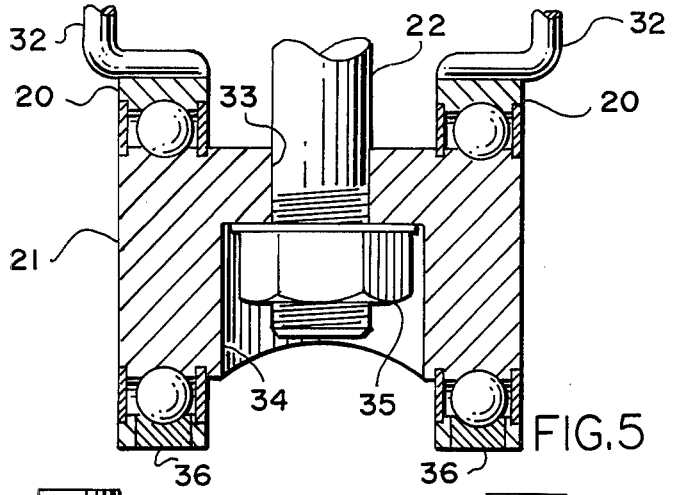
FIG. 5 is a fragmentary cross sectional view taken along the line 5—5 of FIG. 3.
Figure 3:
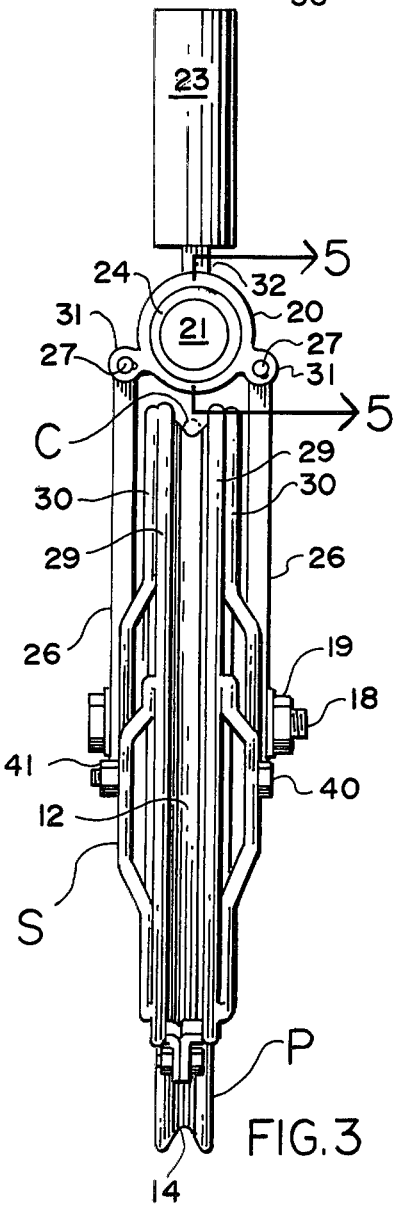
FIG. 3 is an end view in elevation.

In the normal use of my counter-balanced sheave 10, the latter is suspended at its eye bolt 22 so that the cable -C- being payed over the pulley -P- is above ground or platform level, extending downwardly on either side of elevated sheave 10 to permit the latter to pivot in a horizontal plane and swing about in a vertical plane about the shaft 21. With the entire sheave 10 device able to swing in a vertical arc about the eye bolt 22, and pulley -P- pivoting about the shaft 21 as its axis of rotation and the pulley -P- is automatically maintained at all times in a plane passing through the cable. For instance, if for any reason, one end of the cable -C- veers to one side out of the plane of the pulley -P- causing the cable -C- to bear against one side of the insert ring 13, the balanced pulley -P- will pivot about the shaft 21 to maintain the sheave 10 in the plane of the cable -C-. As seen by FIG. 3, the sheave 10 is paying out cable -C- in a vertical position with the plane passing through the pulley -P- and sheave 10 will also pass through the cable -C- as it extends to and from the pulley -P-. If the direction of one or both ends of the cable -C- are changed so that as viewed in FIG. 3 the cable -C- being payed off the pulley -P- toward the reader now swings to the right, the cable -C- will now bear tightly against the right side of the insert rings 12 to cause the sheave 10 to first rotate to the right about the eye bolt 22 and then rotate about the shaft 21 to tilt to the position at which the pulley -P- will lie in the plane of the cable -C-. In this position, the cable -C- will now be lying in the insert ring 13 bearing evenly against each side of the groove of the insert ring 13 whereby the turning moment of the pulley -P- will be at its minimum and the cable -C- will bear evenly on the bearing surfaces.

What I claim as new is:

1. A counter-balanced sheave for supporting a downward extending cable having a tension applied thereto with a substantial vertical component, comprising:

a pulley having a periphery and an axis of rotation, said pulley constructed to lie in a plane having a substantial vertical component;

a pair of support arms, each extending downward on either side of said pulley and having at one end means for rotatably mounting said pulley at said axis of rotation;

hinge means including a pair of end portions defining a pair of arcuate sleeves which are coaxially aligned, a shaft portion extending through each of said arcuate sleeves and operable for pivotal movement about its longitudinal axis, and attachment means for connecting each of said end portions to said pair of support arms at an end of each said support arm which is opposite to the end having said means for mounting said pulley;

suspension means pivotally secured to said shaft portion with its pivotal axis being substantially perpendicular to said longitudinal axis of said shaft portion; and counter-balancing means comprising a pair of substantially equal weighted members positioned to extend above said pulley and mounted to said end portions on opposite sides of said suspension means, whereby said pulley will lie in a plane passing through said cable being payed through said pulley at all times.

2. The counter-balanced sheave of claim 1, wherein said means for rotatably mounting said pulley at said axis of rotation includes a centrally located hub means rigidly secured between said support arms and further includes ball bearing race means interposed between the periphery of said hub means and said pulley for rotational movement of said pulley about said hub means.

3. The counter-balanced sheave of claim 2, wherein ball bearing race means are positioned between said shaft and said end portions to provide relatively frictionless rotational movement about said shaft.

4. The counter-balanced sheave according to claim 3, further including a spider framework having arm members attached to said hub means and extending to a position in close proximity to the periphery of said pulley and cylindrical guard members mounted on the extremities of said arm members on both sides of said pulley to help keep the cable from leaving said pulley.

5. The counter-balanced sheave of claim 4, wherein said pulley comprises a pair of circular members, at least one of said circular members having a slot formed on its peripheral corner, said slot having an L-shaped configuration, said circular members being mounted in face to face, abutting relationship so that said circular members combine to form an outwardly facing peripheral cavity; means for removably securing said circular members together in said face to face, abutting relationship, a ring insert member removably mounted in said peripheral cavity; said ring insert member having a peripherally disposed, outwardly facing groove with an arcuate cross-sectional configuration conforming to the dimensions of said line-like member; said ring insert member having three surfaces configured to conform to the shape of said peripheral cavity and a fourth surface having said arcuate groove formed therein.

* * * * *